US009703225B2

(12) United States Patent
Tajima

(10) Patent No.: US 9,703,225 B2
(45) Date of Patent: Jul. 11, 2017

(54) SEMICONDUCTIVE ROLLER

(71) Applicant: SUMITOMO RUBBER INDUSTRIES, LTD., Kobe-shi, Hyogo (JP)

(72) Inventor: Kei Tajima, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 3 days.

(21) Appl. No.: 15/078,497

(22) Filed: Mar. 23, 2016

(65) Prior Publication Data

US 2016/0313663 A1 Oct. 27, 2016

(30) Foreign Application Priority Data

Apr. 23, 2015 (JP) ..... 2015-088626

(51) Int. Cl.
*G03G 15/02* (2006.01)

(52) U.S. Cl.
CPC ..... *G03G 15/0233* (2013.01)

(58) Field of Classification Search
USPC ..... 399/107, 110, 115, 130, 168, 174, 176, 399/279, 286; 428/411.1; 492/18
See application file for complete search history.

(56) References Cited

U.S. PATENT DOCUMENTS

| | | | | |
|---|---|---|---|---|
| 2004/0106708 | A1 | 6/2004 | Mizumoto et al. | |
| 2006/0074162 | A1 | 4/2006 | Mizumoto et al. | |
| 2011/0101572 | A1* | 5/2011 | Kim | B29C 35/10 264/470 |
| 2011/0281703 | A1 | 11/2011 | Tajima et al. | |
| 2014/0342892 | A1 | 11/2014 | Tajima | |
| 2015/0030868 | A1 | 1/2015 | Tajima | |

FOREIGN PATENT DOCUMENTS

| | | | |
|---|---|---|---|
| JP | 9-160355 | A | 6/1997 |
| JP | 2004-176056 | A | 6/2004 |
| JP | 2005-37602 | A | 2/2005 |
| JP | 2005-132969 | A | 5/2005 |
| JP | 2009-258641 | A | 11/2009 |

* cited by examiner

*Primary Examiner* — Hoan Tran
(74) *Attorney, Agent, or Firm* — Birch, Stewart, Kolasch & Birch, LLP

(57) ABSTRACT

A semiconductive roller (1) is provided, which is formed from a rubber composition and has an outer peripheral surface (4) irradiated with electron radiation in a non-oxidizing atmosphere, wherein the rubber composition contains a rubber component including an epichlorohydrin rubber and a diene rubber, the epichlorohydrin rubber being present in a proportion of 50 mass % to 80 mass %, a thiourea crosslinking agent and/or a triazine crosslinking agent, and a sulfur crosslinking component.

5 Claims, 1 Drawing Sheet

SEMICONDUCTIVE ROLLER

TECHNICAL FIELD

The present invention relates to a semiconductive roller to be used particularly as a charging roller in an electrophotographic image forming apparatus such as a laser printer, an electrostatic copying machine, a plain paper facsimile machine or a printer-copier-facsimile multifunction machine.

BACKGROUND ART

In an image forming apparatus, a semiconductive roller produced by forming a semiconductive rubber composition into a roller form and crosslinking the rubber composition is generally used as a charging roller for uniformly electrically charging a surface of a photoreceptor body, as a developing roller for developing an electrostatic latent image formed by light-exposing the electrically charged photoreceptor surface into a toner image, as a transfer roller for transferring the formed toner image onto a paper sheet or the like, or as a cleaning roller for removing toner from the photoreceptor surface after the transfer of the toner image onto the paper sheet or the like.

The semiconductive roller is incorporated in the image forming apparatus with a shaft such as of a metal inserted through and fixed to a center through-hole thereof for use as the charging roller or the like.

In general, the rubber composition to be used as a material for the semiconductive roller is imparted with ion conductivity by blending an ion-conductive rubber (e.g., an epichlorohydrin rubber) as a rubber component.

Further, a diene rubber is generally used in combination with the ion-conductive rubber as the rubber component in order to improve the mechanical strength and the durability of the semiconductive roller and to impart the semiconductive roller with rubber characteristic properties, i.e., to make the semiconductive roller flexible and less susceptible to permanent compressive deformation with a reduced compression set.

Further, a coating film such as of a urethane resin is generally formed on an outer peripheral surface of the semiconductive roller to be brought into contact with the surface of the photoreceptor body.

The outer peripheral surface of the semiconductive roller is coated with the coating film for the following reason. When the semiconductive roller is used as the charging roller or the like in direct contact with the surface of the photoreceptor body, the image formation is prevented from being influenced by contamination of the photoreceptor body with substances bleeding or blooming on the outer peripheral surface from the inside of the semiconductive roller.

Further, minute particles of external additives such as silica and titanium oxide externally added to the toner for improvement of the fluidity and the electrical chargeability of the toner, or minute particles occurring when toner particles are finely broken during repeated image formation, for example, are prevented from adhering to the outer peripheral surface of the semiconductive roller and gradually accumulating on the outer peripheral surface to influence the image formation.

The coating film is generally formed by applying a coating liquid onto the outer peripheral surface of the semiconductive roller by a coating process such as a spraying method or a dipping method, and then drying the coating liquid. Therefore, the coating film is liable to suffer from contamination with dust and other foreign matter, uneven thickness and other defects during the coating process.

Particularly, if the semiconductive roller suffering from any of these defects is used as the charging roller, it is impossible to uniformly electrically charge the surface of the photoreceptor body. Problematically, this may result in defective image formation such as uneven image density.

In addition, the coating film formation technique, which is an established technique, has little room for improvement. Therefore, it is difficult to significantly reduce the incidence of the defects (defect percentage) as compared with the current technique. This may reduce the yield and the productivity of the semiconductive roller, thereby increasing the production costs.

To cope with this, a thin oxide film is formed instead of the coating film in the outer peripheral surface of the semiconductive roller.

After the semiconductive roller is formed from the semiconductive rubber composition containing the diene rubber as the rubber component (by the molding and the crosslinking of the semiconductive rubber composition), the oxide film is formed in the outer peripheral surface of the semiconductive roller through an oxidization reaction of the diene rubber exposed on the outer peripheral surface by irradiating the outer peripheral surface with ultraviolet radiation in an oxidizing atmosphere or by exposing the outer peripheral surface in an ozone atmosphere (see, for example, Patent Document 1).

Therefore, the oxide film is free from contamination with foreign matter during the formation thereof. In addition, the oxidation reaction uniformly proceeds in the outer peripheral surface of the semiconductive roller, thereby suppressing variations in the thickness of the oxide film.

Particularly, where the semiconductive roller having the oxide film is used as the charging roller, it is possible to uniformly electrically charge the surface of the photoreceptor body, thereby preventing the defective image formation such as image density unevenness.

CITATION LIST

Patent Document

[PATENT DOCUMENT 1] JP-2004-176056A

SUMMARY OF THE INVENTION

Problem to be Solved by the Invention

According to studies conducted by the inventor of the present invention, however, minute particles of hydrophilic external additives such as silica are liable to adhere to the oxide film formed by the irradiation with the ultraviolet radiation or by the exposure to ozone or to the surface of the conventional coating film such as of the urethane resin.

Where the outer peripheral surface of the semiconductive roller is coated with the oxide film or the coating film, therefore, the adhesion and the accumulation of the minute particles occurring due to the breakage of the toner particles can be suppressed to some extent. However, the adhesion and the accumulation of the minute particles of the hydrophilic external additives such as silica cannot be prevented, so that the image formation is liable to be influenced by the adhesion and the accumulation of the minute particles during the repeated image formation.

It is an object of the present invention to provide a semiconductive roller which is capable of more uniformly electrically charging the surface of the photoreceptor body without the contamination of the photoreceptor body to suppress the image density unevenness, for example, when being used as a charging roller, and substantially free from the adhesion and the accumulation of various types of minute particles including the hydrophilic external additives such as silica, so that the image formation can be continuously properly performed for a longer period of time.

Solution to Problem

According to the present invention, there is provided a semiconductive roller, which is formed of a crosslinking product of a rubber composition and has an outer peripheral surface irradiated with electron radiation in a non-oxidizing atmosphere, wherein the rubber composition contains a rubber component including an epichlorohydrin rubber and a diene rubber, the epichlorohydrin rubber being present in a proportion of not less than 50 mass % and not greater than 80 mass % based on the total amount of the epichlorohydrin rubber and the diene rubber, at least one crosslinking agent selected from the group consisting of a thiourea crosslinking agent and a triazine crosslinking agent, and a sulfur crosslinking component.

Effects of the Invention

According to the present invention, the semiconductive roller is capable of more uniformly electrically charging the surface of the photoreceptor body without the contamination of the photoreceptor body to suppress the image density unevenness, for example, when being used as a charging roller, and substantially free from the adhesion and the accumulation of various types of minute particles including the hydrophilic external additives such as silica, so that the image formation can be continuously properly performed for a longer period of time.

EMBODIMENTS OF THE INVENTION

Figure 1:
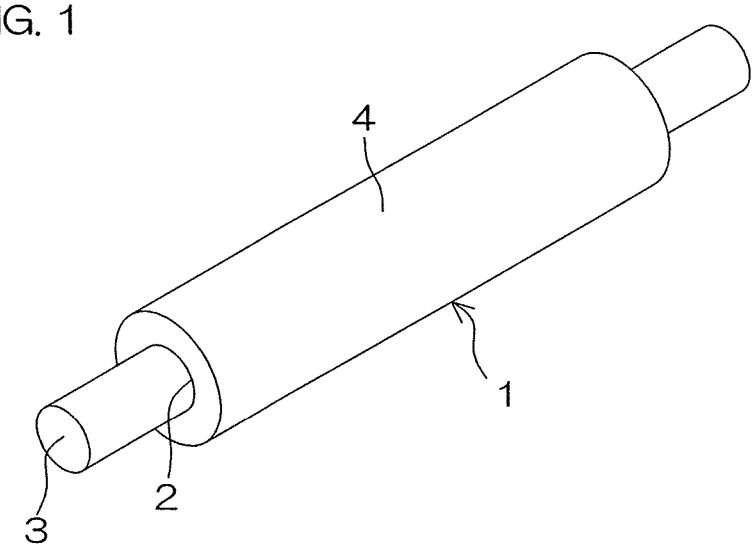
FIG. 1 is a perspective view illustrating an exemplary semiconductive roller according to one embodiment of the present invention.

The inventive semiconductive roller is formed of a crosslinking product of a rubber composition and has an outer peripheral surface irradiated with electron radiation in a non-oxidizing atmosphere, wherein the rubber composition contains a rubber component including an epichlorohydrin rubber and a diene rubber, the epichlorohydrin rubber being present in a proportion of not less than 50 mass % and not greater than 80 mass % based on the total amount of the epichlorohydrin rubber and the diene rubber, at least one crosslinking agent selected from the group consisting of a thiourea crosslinking agent and a triazine crosslinking agent, and a sulfur crosslinking component.

According to the present invention, the semiconductive roller is produced by molding and crosslinking the rubber composition containing the aforementioned ingredients, whereby the rubber characteristic properties of the semiconductive roller can be improved, i.e., the semiconductive roller is made more flexible and less susceptible to permanent compressive deformation with a reduced compression set.

According to the present invention, part of the diene rubber exposed on the outer peripheral surface of the semiconductive roller is mainly modified by irradiating the outer peripheral surface with the electron radiation in the non-oxidizing atmosphere. Thus, the outer peripheral surface can be modified into a state such as to suppress the contamination of the photoreceptor body with substances bleeding or blooming from the inside of the semiconductive roller as in the case in which the oxide film or the like is formed in the outer peripheral surface.

In addition, the irradiation of the outer peripheral surface of the semiconductive roller with the electron radiation in the non-oxidizing atmosphere makes it possible to modify the outer peripheral surface into the aforementioned state without the formation of the oxide film through the oxidation of the diene rubber. Thus, the adhesion and the accumulation of the minute particles including the hydrophilic external additives on the outer peripheral surface can be more advantageously suppressed.

In addition, the modification by the irradiation with the electron radiation proceeds uniformly in the outer peripheral surface of the semiconductive roller, so that the outer peripheral surface is free from variations in modification state and modification thickness and contamination with dust and other foreign matter.

According to the present invention, the semiconductive roller is capable of more uniformly electrically charging the surface of the photoreceptor body without the contamination of the photoreceptor body to suppress the image density unevenness, for example, when being used as a charging roller, and substantially free from the adhesion and the accumulation of various types of minute particles including the hydrophilic external additives such as silica, so that the image formation can be continuously properly performed for a longer period of time.

<<Rubber Composition>>

<Rubber Component>

As described above, the rubber component includes the epichlorohydrin rubber and the diene rubber, and the proportion of the epichlorohydrin rubber is limited to a range of not less than 50 mass % and not greater than 80 mass % based on the total amount of the epichlorohydrin rubber and the diene rubber.

If the proportion of the epichlorohydrin rubber is less than the aforementioned range, it will be impossible to properly impart the semiconductive roller with semiconductivity suitable for the charging roller.

If the proportion of the epichlorohydrin rubber is greater than the aforementioned range, on the other hand, the proportion of the diene rubber to be mainly modified by the irradiation with the electron radiation will be relatively reduced, making it impossible to sufficiently modify the outer peripheral surface of the semiconductive roller. Therefore, the contamination of the photoreceptor body, and the adhesion and the accumulation of the minute particles on the outer peripheral surface are more liable to occur. Further, the proportion of the diene rubber which imparts the semiconductive roller with the rubber characteristic properties is relatively reduced, so that the semiconductive roller is liable to have an increased compression set to suffer from permanent compressive deformation.

Where the proportion of the epichlorohydrin rubber is not less than 50 mass % and not greater than 80 mass %, in contrast, it is possible to properly modify the outer peripheral surface to suppress the contamination of the photoreceptor body and the adhesion and the accumulation of the minute particles on the outer peripheral surface while properly imparting the semiconductive roller with the semiconductivity and the rubber characteristic properties.

For further improvement of these effects, the proportion of the epichlorohydrin rubber is preferably not greater than 60 mass % in the aforementioned range.

(Epichlorohydrin Rubber)

Various ion-conductive polymers having epichlorohydrin as a repeating unit are usable as the epichlorohydrin rubber.

Examples of the epichlorohydrin rubber include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used alone or in combination.

Of these epichlorohydrin rubbers, the ethylene oxide-containing copolymers, particularly the ECO and/or the GECO are preferred.

These copolymers preferably each have an ethylene oxide content of not less than 30 mol % and not greater than 80 mol %, particularly preferably not less than 50 mol %.

Ethylene oxide functions to reduce the roller resistance of the semiconductive roller. If the ethylene oxide content is less than the aforementioned range, however, it will be impossible to sufficiently provide this function and hence to sufficiently reduce the roller resistance.

If the ethylene oxide content is greater than the aforementioned range, on the other hand, ethylene oxide is liable to be crystallized, whereby the segment motion of molecular chains is hindered to adversely increase the roller resistance. Further, the semiconductive roller is liable to have an excessively high hardness after the crosslinking, and the rubber composition is liable to have a higher viscosity and, hence, poorer processability when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the semiconductive roller. However, if the allyl glycidyl ether content is less than the aforementioned range, it will be impossible to provide this function and hence to sufficiently reduce the roller resistance.

Allyl glycidyl ether also functions as crosslinking sites during the crosslinking of the GECO. Therefore, if the allyl glycidyl ether content is greater than the aforementioned range, the crosslinking density of the GECO is excessively increased, whereby the segment motion of molecular chains is hindered to adversely increase the roller resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

(Diene Rubber)

Examples of the diene rubber include a natural rubber, an isoprene rubber (IR), a butadiene rubber (BR), a styrene butadiene rubber (SBR), a chloroprene rubber (CR) and an acrylonitrile butadiene rubber (NBR), which may be used alone or in combination.

Particularly, the NBR is preferred. The NBR is effective as the diene rubber, i.e., the NBR is properly modified by the irradiation with the electron radiation in the non-oxidizing atmosphere to effectively prevent the contamination of the photoreceptor body due to the bleeding or the blooming and effectively impart the semiconductive rubber with excellent rubber characteristic properties.

(NBR)

The NBR is classified in a lower acrylonitrile content type, an intermediate acrylonitrile content type, an intermediate to higher acrylonitrile content type, a higher acrylonitrile content type or a very high acrylonitrile content type depending on the acrylonitrile content. Any of these types of NBRs is usable.

The NBRs include those of an oil-extension type having flexibility controlled by addition of an extension oil, and those of a non-oil-extension type containing no extension oil. Where the inventive semiconductive roller is used as a charging roller or the like, a non-oil-extension type NBR is preferably used for prevention of the contamination of the photoreceptor body.

These NBRs may be used alone or in combination.

<Crosslinking Component>

As the crosslinking component for crosslinking the rubber component, at least one crosslinking agent selected from the group consisting of the thiourea crosslinking agent and the triazine crosslinking agent, and the sulfur crosslinking component are used in combination.

The thiourea crosslinking agent and/or the triazine crosslinking agent function to mainly crosslink the epichlorohydrin rubber, and the sulfur crosslinking agent functions to mainly crosslink the diene rubber. The combinational use of these crosslinking agents and the crosslinking component makes it possible to impart the entire semiconductive roller with the rubber characteristic properties. That is, the semiconductive roller is made flexible and less susceptible to permanent compressive deformation with a reduced compression set.

(Thiourea Crosslinking Agent)

Various thiourea compounds each having a thiourea structure in a molecule thereof and functioning as a crosslinking agent for the epichlorohydrin rubber are usable as the thiourea crosslinking agent.

Examples of the thiourea crosslinking agent include ethylene thiourea (also referred to as 2-mercaptoimidazoline), diethylthiourea and dibutylthiourea, which may be used alone or in combination. Particularly, ethylene thiourea is preferred.

The proportion of the thiourea crosslinking agent to be blended is preferably not less than 0.3 parts by mass and not greater than 1 part by mass based on 100 parts by mass of the overall rubber component, i.e., based on 100 parts by mass of the total of the epichlorohydrin rubber and the diene rubber.

If the proportion of the thiourea crosslinking agent is less than the aforementioned range, the crosslinking of the epichlorohydrin rubber will be insufficient, so that the semiconductive roller is liable to have an increased compression set to suffer from the permanent compressive deformation.

If the proportion of the thiourea crosslinking agent is greater than the aforementioned range, on the other hand, the semiconductive roller is liable to have an excessively high hardness and hence have poor conformability to the photoreceptor body. This may result in image density unevenness, for example, occurring at the pitch of the semiconductive roller. Further, an excess amount of the thiourea crosslinking agent is liable to bloom on the outer peripheral surface of the semiconductive roller to hinder the modification of the outer peripheral surface by the irradiation with the electron radiation and contaminate the photoreceptor body.

(Accelerating Agent)

Any of various accelerating agents which accelerate the crosslinking reaction of the epichlorohydrin rubber by the thiourea crosslinking agent may be used in combination with the thiourea crosslinking agent.

Examples of the accelerating agent include guanidine accelerating agents such as 1,3-diphenylguanidine (D), 1,3-di-o-tolylguanidine (DT) and 1-o-tolylbiguanide (BG), which may be used alone or in combination.

The proportion of the accelerating agent to be blended is preferably not less than 0.3 parts by mass and not greater than 1 part by mass based on 100 parts by mass of the overall rubber component in order to sufficiently provide the effect of accelerating the crosslinking of the epichlorohydrin rubber.

(Triazine Crosslinking Agent)

Various triazine compounds each having a triazine structure in a molecule thereof and functioning as a crosslinking agent for the epichlorohydrin rubber are usable as the triazine crosslinking agent.

Examples of the triazine crosslinking agent include 2,4,6-trimercapto-s-triazine, 2-anilino-4,6-dimercapto-s-triazine and 2-dibutylamino-4,6-dimercapto-s-triazine, which may be used alone or in combination.

The proportion of the triazine crosslinking agent to be blended is preferably not less than 0.5 parts by mass and not greater than 3.0 parts by mass based on 100 parts by mass of the overall rubber component.

If the proportion of the triazine crosslinking agent is less than the aforementioned range, the crosslinking of the epichlorohydrin rubber will be insufficient, so that the semiconductive roller is liable to have an increased compression set to suffer from the permanent compressive deformation.

If the proportion of the triazine crosslinking agent is greater than the aforementioned range, on the other hand, the semiconductive roller is liable to have an excessively high hardness and hence have poor conformability to the photoreceptor body. This may result in image density unevenness, for example, occurring at the pitch of the semiconductive roller. Further, an excess amount of the triazine crosslinking agent is liable to bloom on the outer peripheral surface of the semiconductive roller to hinder the modification of the outer peripheral surface by the irradiation with the electron radiation and contaminate the photoreceptor body.

(Sulfur Crosslinking Component)

At least one crosslinking agent selected from the group consisting of sulfur and a sulfur-containing crosslinking agent is used in combination with a sulfur-containing accelerating agent as the sulfur crosslinking component.

Various organic compounds each containing sulfur in a molecule thereof and functioning as a crosslinking agent for the diene rubber are usable as the sulfur-containing crosslinking agent. An example of the sulfur-containing crosslinking agent is 4,4'-dithiodimorpholine (R).

However, the sulfur is preferred as the crosslinking agent.

The proportion of the sulfur to be blended is preferably not less than 1 part by mass and not greater than 2 parts by mass based on 100 parts by mass of the overall rubber component.

If the proportion of the sulfur is less than the aforementioned range, it will be impossible to properly crosslink the diene rubber to impart the semiconductive roller with excellent rubber characteristic properties, i.e., to make the semiconductive roller flexible and less susceptible to the permanent compressive deformation with a reduced compression set.

If the proportion of the sulfur is greater than the aforementioned range, on the other hand, an excess amount of the sulfur is liable to blood on the outer peripheral surface of the semiconductive roller to hinder the modification of the outer peripheral surface by the irradiation with the electron radiation and contaminate the outer peripheral surface.

Where the sulfur-containing crosslinking agent is used as the crosslinking agent, the proportion of the sulfur-containing crosslinking agent is preferably adjusted so that the proportion of sulfur contained in the molecule of the sulfur-containing crosslinking agent falls within the aforementioned range based on 100 parts by mass of the overall rubber component.

Examples of the sulfur-containing accelerating agent include a thiazole accelerating agent, a thiuram accelerating agent, a sulfenamide accelerating agent and a dithiocarbamate accelerating agent, which may be used alone or in combination. Among these accelerating agents, the thiazole accelerating agent and the thiuram accelerating agent are preferably used in combination.

Examples of the thiazole accelerating agent include 2-mercaptobenzothiazole (M), di-2-benzothiazolyl disulfide (DM), a zinc salt of 2-mercaptobenzothiazole (MZ), a cyclohexylamine salt of 2-mercaptobenzothiazole (HM, M60-OT), 2-(N,N-diethylthiocarbamoylthio)benzothiazole (64) and 2-(4'-morpholinodithio)benzothiazole (DS, MDB), which may be used alone or in combination. Particularly, di-2-benzothiazolyl disulfide (DM) is preferred.

Examples of the thiuram accelerating agent include tetramethylthiuram monosulfide (TS), tetramethylthiuram disulfide (TT, TMT), tetraethylthiuram disulfide (TET), tetrabutylthiuram disulfide (TBT), tetrakis(2-ethylhexyl)thiuram disulfide (TOT-N) and dipentamethylenethiuram tetrasulfide (TRA), which may be used alone or in combination. Particularly, tetramethylthiuram monosulfide (TS) is preferred.

Where the two types of sulfur-containing accelerating agents are used in combination, the proportion of the thiazole accelerating agent to be blended is preferably not less than 1 part by mass and not greater than 2 parts by mass based on 100 parts by mass of the overall rubber component in order to sufficiently provide the effect of accelerating the crosslinking of the diene rubber. The proportion of the thiuram accelerating agent to be blended is preferably not less than 0.3 parts by mass and not greater than 0.9 parts by mass based on 100 parts by mass of the overall rubber component.

<Electrically Conductive Agent>

The rubber composition preferably further contains a salt (ion salt) containing an anion having a fluoro group and a sulfonyl group and a cation in its molecule as an electrically conductive agent.

With the use of the rubber composition containing the ion salt as the electrically conductive agent, the semiconductive roller is imparted with proper semiconductivity.

Examples of the anion having the fluoro group and the sulfonyl group in the molecule of the ion salt include fluoroalkyl sulfonate ions, bis(fluoroalkylsulfonyl)imide ions and tris(fluoroalkylsulfonyl)methide ions, which may be used alone or in combination.

Examples of the fluoroalkyl sulfonate ions include $CF_3SO_3^-$ and $C_4F_9SO_3^-$, which may be used alone or in combination.

Examples of the bis(fluoroalkylsulfonyl)imide ions include $(CF_3SO_2)_2N^-$, $(C_2F_5SO_2)_2N^-$, $(C_4F_9SO_2)(CF_3SO_2)N^-$, $(FSO_2C_5F_4)(CF_3SO_2)N^-$, $(C_8F_{17}SO_2)(CF_3SO_2)N^-$, $(CF_3CH_2OSO_2)_2N^-$, $(CF_3CF_2CH_2OSO_2)_2N^-$, $(HCF_2CF_2CH_2OSO_2)_2N^-$ and $[(CF_3)_2CHOSO_2]_2N^-$, which may be used alone or in combination.

Examples of the tris(fluoroalkylsulfonyl)methide ions include $(CF_3SO_2)_3C^-$ and $(CF_3CH_2OSO_2)_3C^-$, which may be used alone or in combination.

Examples of the cation include ions of alkali metals such as sodium, lithium and potassium, ions of Group II elements such as beryllium, magnesium, calcium, strontium and barium, ions of transition elements, cations of amphoteric elements, a quaternary ammonium ion and an imidazolium cation, which may be used alone or in combination.

Particularly, lithium salts containing the lithium ion as the cation and potassium salts containing the potassium ion as the cation are preferred as the ion salt.

Among these ion salts, $(CF_3SO_2)_2NLi$ (lithium bis(trifluoromethanesulfonyl)imide) and/or $(CF_3SO_2)_2NK$ (potassium bis(trifluoromethanesulfonyl)imide) are preferred for improvement of the ion conductivity of the rubber composition for reduction of the roller resistance of the semiconductive roller.

The proportion of the ion salt to be blended is preferably not less than 0.5 parts by mass and not greater than 5 parts by mass, particularly preferably not less than 0.8 parts by mass and not greater than 4 parts by mass, based on 100 parts by mass of the overall rubber component.

If the proportion of the ion salt is less than the aforementioned range, it will be impossible to sufficiently provide the effect of improving the ion conductivity of the semiconductive roller to reduce the roller resistance of the semiconductive roller.

If the proportion of the ion salt is greater than the aforementioned range, on the other hand, the intended effect will not be further enhanced, but an excess amount of the ion salt is liable to bloom on the outer peripheral surface of the semiconductive roller to hinder the modification of the outer peripheral surface by the irradiation with the electron radiation and contaminate the photoreceptor body.

<Other Ingredients>

As required, various additives may be added to the rubber composition.

Examples of the additives include a crosslinking assisting agent, an acid accepting agent, a plasticizing agent, a processing aid, a degradation preventing agent, a filler, an anti-scorching agent, a lubricant, a pigment, an anti-static agent, a flame retarder, a neutralizing agent, a nucleating agent and a co-crosslinking agent.

The types and the proportions of these additives to be blended may be determined particularly in consideration of proper balance between the resistance of the semiconductive roller and the effect of suppressing the adhesion and the accumulation of the minute particles on the outer peripheral surface.

Examples of the crosslinking assisting agent include metal compounds such as zinc white, fatty acids such as stearic acid, oleic acid and cotton seed fatty acids, and other conventionally known crosslinking assisting agents, which may be used alone or in combination.

The proportions of these crosslinking assisting agents to be blended are preferably each not less than 0.1 part by mass and not greater than 7 parts by mass, particularly preferably not less than 0.5 parts by mass and not greater than 5 parts by mass, based on 100 parts by mass of the overall rubber component.

In the presence of the acid accepting agent, chlorine-containing gases generated from the epichlorohydrin rubber and the CR during the crosslinking of the rubber component are prevented from remaining in the semiconductive roller. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 0.5 parts by mass and not greater than 6 parts by mass, particularly preferably not less than 1 part by mass and not greater than 5 parts by mass, based on 100 parts by mass of the overall rubber component.

Examples of the plasticizing agent include plasticizers such as dibutyl phthalate (DBP), dioctyl phthalate (DOP) and tricresyl phosphate, and waxes such as polar waxes. Examples of the processing aid include fatty acids such as stearic acid.

The proportion of the plasticizing agent and/or the processing aid to be blended is preferably not greater than 5 parts by mass based on 100 parts by mass of the overall rubber component. This prevents the contamination of the photoreceptor body, for example, when the semiconductive roller is mounted in an image forming apparatus or when the image forming apparatus is operated. For this purpose, it is preferred to use any of the polar waxes out of the plasticizing agents.

Examples of the degradation preventing agent include various anti-aging agents and anti-oxidants.

The anti-oxidants serve to reduce the environmental dependence of the roller resistance of the semiconductive roller and to suppress the increase in roller resistance during continuous energization of the semiconductive roller. Examples of the anti-oxidants include nickel diethyldithiocarbamate and nickel dibutyldithiocarbamate.

Examples of the filler include titanium oxide, zinc oxide, silica, carbon, carbon black, clay, talc, calcium carbonate, magnesium carbonate and aluminum hydroxide, which may be used alone or in combination.

The blending of the filler improves the mechanical strength and the like of the semiconductive roller.

The proportion of the filler to be blended is preferably not less than 5 parts by mass and not greater than 25 parts by mass, particularly preferably not greater than 20 parts by mass, based on 100 parts by mass of the overall rubber component.

An electrically conductive filler such as electrically conductive carbon black may be blended as the filler to impart the semiconductive roller with electron conductivity.

A preferred example of the electrically conductive carbon black is HAF. The HAF can be homogenously dispersed in the rubber composition and, therefore, impart the semiconductive roller with more uniform electron conductivity.

The proportion of the electrically conductive carbon black to be blended is preferably not less than 1 part by mass and not greater than 8 parts by mass, particularly preferably not less than 3 parts by mass and not greater than 6 parts by mass, based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used alone or in combination. Particularly, N-cyclohexylthiophthalimide is preferred.

The proportion of the anti-scorching agent to be blended is preferably not less than 0.1 part by mass and not greater than 5 parts by mass, particularly preferably not greater than 1 part by mass, based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used alone or in combination.

Examples of the ethylenically unsaturated monomers include:

(a) monocarboxylic acids such as acrylic acid, methacrylic acid and crotonic acid;
(b) dicarboxylic acids such as maleic acid, fumaric acid and itaconic acid;
(c) esters and anhydrides of the unsaturated carboxylic acids (a) and (b);
(d) metal salts of the monomers (a) to (c);
(e) aliphatic conjugated dienes such as 1,3-butadiene, isoprene and 2-chloro-1,3-butadiene;
(f) aromatic vinyl compounds such as styrene, α-methylstyrene, vinyltoluene, ethylvinylbenzene and divinylbenzene;
(g) vinyl compounds such as triallyl isocyanurate, triallyl cyanurate and vinylpyridine each having a hetero ring; and
(h) cyanovinyl compounds such as (meth)acrylonitrile and α-chloroacrylonitrile, acrolein, formyl sterol, vinyl methyl ketone, vinyl ethyl ketone and vinyl butyl ketone.

These ethylenically unsaturated monomers may be used alone or in combination.

Monocarboxylic acid esters are preferred as the esters (c) of the unsaturated carboxylic acids.

Specific examples of the monocarboxylic acid esters include:

alkyl (meth)acrylates such as methyl (meth)acrylate, ethyl (meth)acrylate, n-propyl (meth)acrylate, i-propyl (meth) acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth)acrylate, tert-butylcyclohexyl (meth)acrylate, decyl (meth)acrylate, dodecyl (meth)acrylate, hydroxymethyl (meth)acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth)acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used alone or in combination.

The rubber composition containing the ingredients described above can be prepared in a conventional manner.

First, the rubbers for the rubber component are blended in the predetermined proportions, and the resulting rubber component is simply kneaded. After additives other than the crosslinking component are added to and kneaded with the rubber component, the crosslinking component is finally added to and further kneaded with the resulting mixture. Thus, the rubber composition is provided.

A sealed kneading machine such as an Intermix mixer, a Banbury mixer, a kneader or an extruder, an open roll or the like, for example, is usable for the kneading.

<<Semiconductive Roller>>

FIG. 1 is a perspective view illustrating an exemplary semiconductive roller according to one embodiment of the present invention.

Referring to FIG. 1, the semiconductive roller 1 according to this embodiment includes a tubular body formed from the rubber composition containing the aforementioned ingredients, and has an outer peripheral surface 4 modified by the irradiation with the electron radiation in the non-oxidizing atmosphere, and a shaft 3 is inserted through a center through-hole 2 of the tubular body and fixed to the through-hole 2.

The shaft 3 is made of a metal such as aluminum, an aluminum alloy or a stainless steel.

The shaft 3 is electrically connected to and mechanically fixed to the semiconductive roller 1, for example, via an electrically conductive adhesive agent. Alternatively, a shaft having an outer diameter that is greater than the inner diameter of the through-hole 2 is used as the shaft 3, and press-inserted into the through-hole 2 to be electrically connected to and mechanically fixed to the semiconductive roller 1. Thus, the shaft 3 and the semiconductive roller 1 are unitarily rotatable.

The semiconductive roller 1 is formed of the crosslinking product of the rubber composition containing the aforementioned ingredients and, therefore, has excellent rubber characteristic properties. That is, the semiconductive roller 1 is flexible, and less susceptible to permanent compressive deformation with a reduced compression set.

Further, part of the diene rubber exposed on the outer peripheral surface 4 is modified by irradiating the outer peripheral surface 4 with the electron radiation in the non-oxidizing atmosphere. Thus, the outer peripheral surface 4 can be modified into a state such as to suppress the contamination of the photoreceptor body with substances bleeding or blooming from the inside of the semiconductive roller 1 as in the case in which an oxide film or the like is formed in the outer peripheral surface 4.

Further, the irradiation with the electron radiation in the non-oxidizing atmosphere makes it possible to modify the outer peripheral surface 4 of the semiconductive roller 1 into the aforementioned state without the formation of the oxide film through the oxidation of the diene rubber. Thus, the adhesion and the accumulation of the minute particles including the hydrophilic external additives on the outer peripheral surface 4 can be more advantageously suppressed.

In addition, the modification by the irradiation with the electron radiation proceeds uniformly in the outer peripheral surface 4 of the semiconductive roller 1, so that the outer peripheral surface 4 is free from variations in modification state and modification thickness and contamination with dust and other foreign matter.

Therefore, the semiconductive roller 1 is advantageously used, for example, as a charging roller for uniformly electrically charging the surface of the photoreceptor body in an electrophotographic image forming apparatus such as a laser printer.

For the production of the semiconductive roller 1, the rubber composition preliminarily prepared is first extruded into a tubular body by means of an extruder. Then, the tubular body is cut to a predetermined length, and heated in a vulcanization can to crosslink the rubber component.

In turn, the tubular body thus crosslinked is heated in an oven for secondary crosslinking, then cooled, and polished as having a predetermined outer diameter and a predetermined surface roughness.

Various polishing methods such as dry traverse polishing method may be used for the polishing.

Further, the polished semiconductive roller 1 is placed, for example, in a treatment chamber of an electron irradiation apparatus not shown. While the non-oxidizing atmosphere is produced in the treatment chamber by purging the treatment chamber with nitrogen, the outer peripheral surface 4 is irradiated with the electron radiation. Thus, the semiconductive roller 1 shown in FIG. 1 is produced.

The shaft 3 may be inserted into and fixed to the through-hole 2 at any time between the end of the cutting of the tubular body and the end of the polishing.

However, the tubular body is preferably secondarily crosslinked and polished with the shaft 3 inserted through the through-hole 2 after the cutting. This prevents warpage and deformation of the semiconductive roller 1 which may otherwise occur due to expansion and contraction of the tubular body in the secondary crosslinking. Further, the tubular body may be polished while being rotated about the shaft 3. This improves the working efficiency in the polishing, and suppresses deflection of the outer peripheral surface 4.

As previously described, the shaft 3 may be inserted through the through-hole 2 of the tubular body with the intervention of the electrically conductive adhesive agent (particularly, a thermosetting adhesive agent) before the secondary crosslinking, or the shaft 3 having an outer diameter greater than the inner diameter of the through-hole 2 may be press-inserted into the through-hole 2.

In the former case, the thermosetting adhesive agent is cured when the tubular body is secondarily crosslinked by the heating in the oven. Thus, the shaft 3 is electrically connected to and mechanically fixed to the semiconductive roller 1.

In the latter case, the electrical connection and the mechanical fixing are achieved simultaneously with the press insertion.

Alternatively, the semiconductive roller 1 may be produced by press-molding and crosslinking the rubber composition in a mold having a three-dimensional shape conformal to the semiconductive roller 1 to form a tubular body, and irradiating the outer peripheral surface 4 with the electron radiation in the non-oxidizing atmosphere.

In the press-molding, the shaft 3 may be set in a predetermined position in the press-molding mold, for example, with an electrically conductive thermo-setting adhesive agent applied on the outer peripheral surface thereof, whereby the shaft 3 is electrically connected to and mechanically fixed to the semiconductive roller 1 simultaneously with the press-molding and the crosslinking of the rubber composition.

As in the aforementioned case, the shaft 3 may be inserted through the through-hole 2 of the semiconductive roller 1 thus press-molded in the tubular shape to be electrically connected to and mechanically fixed to the semiconductive roller 1, for example, via the electrically conductive adhesive agent, or the shaft 3 having an outer diameter greater than the inner diameter of the through-hole 2 may be press-inserted into the through-hole 2 to be electrically connected to and mechanically fixed to the semiconductive roller 1.

The semiconductive roller 1 may have a double-layer structure which includes an outer layer provided on the side of the outer peripheral surface 4 and an inner layer provided on the side of the shaft 3. In this case, at least the outer layer may satisfy the requirements of the present invention. Further, the semiconductive roller 1 may have a porous structure.

However, the semiconductive roller 1 preferably has a nonporous single-layer structure for simplification of the structure thereof for production at lower costs with higher productivity and for improvement of the durability and the compression set characteristics thereof.

The inventive semiconductive roller 1 preferably has a roller resistance of not less than $10^4\Omega$ and not greater than $10^6\Omega$ as measured with an application voltage of 200V in an ordinary temperature and ordinary humidity environment at a temperature of 23±2° C. at a relative humidity of 55±2%. It is noted that the roller resistance of the semiconductive roller 1 is a roller resistance measured after the outer peripheral surface 4 is irradiated with the electron radiation in the non-oxidizing atmosphere.

<<Method for Measuring Roller Resistance>>

Figure 2:
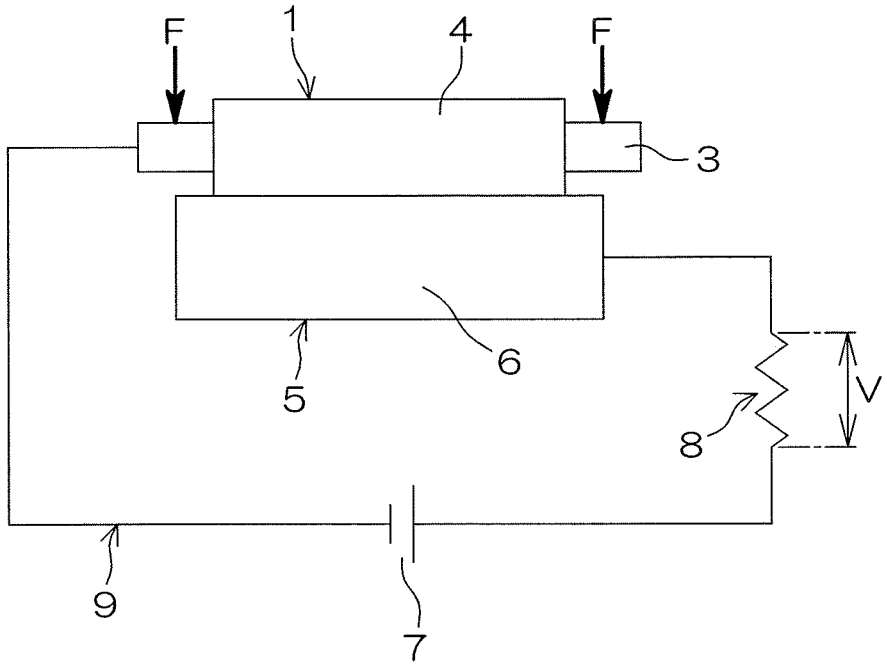
FIG. 2 is a diagram for explaining how to measure the roller resistance of the semiconductive roller.

FIG. 2 is a diagram for explaining how to measure the roller resistance of the semiconductive roller 1.

Referring to FIGS. 1 and 2, the roller resistance is measured in the following manner in the present invention.

An aluminum drum 5 rotatable at a constant rotation speed is prepared, and the outer peripheral surface 4 of the semiconductive roller 1 to be subjected to the measurement of the roller resistance is brought into contact with an outer peripheral surface 6 of the aluminum drum 5 from above.

A DC power source 7 and a resistor 8 are connected in series between the shaft 3 of the semiconductive roller 1 and the aluminum drum 5 to provide a measurement circuit 9. The DC power source 7 is connected to the shaft 3 at its negative terminal, and connected to the resistor 8 at its positive terminal. The resistor 8 has a resistance r of 100Ω.

Subsequently, a load F of 450 g is applied to each of opposite end portions of the shaft 3 to bring the semiconductive roller 1 into press contact with the aluminum drum 5 and, in this state, a detection voltage V applied to the resistor 8 is measured by applying an application voltage E of DC 200 V from the DC power source 7 between the shaft 3 and the aluminum drum 5 while rotating the aluminum drum 5 at a rotation speed of 40 rpm.

The roller resistance R of the semiconductive roller 1 is basically determined from the following expression (i') based on the detection voltage V and the application voltage E (=200 V):

$$R=r\times E/(V-r) \quad \text{(i')}$$

However, the term −r in the denominator of the expression (i') is negligible, so that the roller resistance of the semiconductive roller 1 is expressed by a value determined from the following expression (i) in the present invention:

$$R=r\times E/V \quad \text{(i)}$$

As described above, a temperature of 23±2° C. and a relative humidity of 55±2% are employed as conditions for the measurement.

The hardness and the compression set of the semiconductive roller 1 can be controlled according to the use purpose of the semiconductive roller 1. The control of the hardness, the compression set, the roller resistance and the like can be achieved, for example, by controlling the proportion of the epichlorohydrin rubber within the aforementioned range based on the amount of the rubber component, and controlling the types and the amounts of the thiourea cross linking agent and the triazine crosslinking agent as the crosslinking component, and the types and the amounts of the substances for the sulfur crosslinking component.

The inventive semiconductive roller can be advantageously used not only as the charging roller but also as a developing roller, a transfer roller, a cleaning roller or the like in an electrophotographic image forming apparatus such as a laser printer, an electrostatic copying machine, a plain paper facsimile machine or a printer-copier-facsimile multifunction machine.

EXAMPLES

Example 1

Preparation of Rubber Composition

For preparation of a rubber component, 60 parts by mass of an ECO (EPICHLOMER (registered trade name) D available from Daiso Co., Ltd. and having an ethylene oxide content of 61 mol %) as an epichlorohydrin rubber and 40 parts by mass of an NBR (lower acrylonitrile content NBR JSR N250 SL available from JSR Co., Ltd. and having an acrylonitrile content of 20%) as a diene rubber were used in combination.

While 100 parts by mass of the rubber component was simply kneaded by a 9-L kneader, 1 part by mass of potassium bis(trifluoromethanesulfonyl)imide (electrically conductive agent EF-N112 available from Mitsubishi Materials Electronic Chemicals Co., Ltd.), 5 parts by mass of hydrotalcites (acid accepting agent DHT-4A (registered trade name) 2 available from Kyowa Chemical Industry Co., Ltd.) and 5 parts by mass of zinc oxide type-2 (crosslinking assisting agent available from Mitsui Mining & Smelting Co., Ltd.) were first added to and kneaded with the rubber component.

While the resulting mixture was continuously kneaded, the following crosslinking component was further added to and kneaded with the mixture. Thus, the rubber composition was prepared. The proportion of the ECO was 60 mass % based on the amount of the rubber component.

TABLE 1

| Ingredients | Parts by mass |
|---|---|
| Thiourea crosslinking agent | 0.60 |
| Accelerating agent DT | 0.54 |
| Sulfur powder | 1.50 |
| Accelerating agent DM | 1.50 |
| Accelerating agent TS | 0.50 |

The ingredients shown in Table 1 are as follows. The proportions (parts by mass) shown in Table 1 are based on 100 parts by mass of the overall rubber component.

Thiourea crosslinking agent: Ethylene thiourea (2-mercaptoimidazoline ACCEL (registered trade name) 22-S available from Kawaguchi Chemical Industry Co., Ltd.)

Accelerating agent DT: 1,3-di-o-tolylguanidine (guanidine accelerating agent NOCCELER (registered trade name) DT available from Ouchi Shinko Chemical Industrial Co., Ltd.)

Sulfur powder: Crosslinking agent (available from Tsurumi Chemical Industry Co., Ltd.)

Accelerating agent DM: Di-2-benzothiazolyl disulfide (thiazole accelerating agent NOCCELER DM available from Ouchi Shinko Chemical Industrial Co., Ltd.)

Accelerating agent TS: Tetramethylthiuram monosulfide (thiuram accelerating agent NOCCELER TS available from Ouchi Shinko Chemical Industrial Co., Ltd.)

Production of Semiconductive Roller

The rubber composition thus prepared was fed into a ϕ60 extruder, and extruded into a tubular body having an outer diameter of 11.0 mm and an inner diameter of 5.0 mm. Then, the tubular body was fitted around a temporary crosslinking shaft, and crosslinked in a vulcanization can at 160° C. for 30 minutes.

Then, the crosslinked tubular body was removed from the temporary shaft, then fitted around a metal shaft having an outer diameter of 6 mm and an outer peripheral surface to which an electrically conductive thermosetting adhesive agent (polyamide adhesive agent) was applied, and heated in an oven at 150° C. for 60 minutes. Thus, the tubular body was bonded to the metal shaft. After opposite end portions of the tubular body were cut, the outer peripheral surface of the resulting tubular body was dry-polished to an outer diameter of 9.5 mm by means of a wide polishing machine, and wet-polished with a #400 paper by means of a wet paper polishing machine.

After the polished outer peripheral surface was wiped with an alcohol, the tubular body was set in a treatment chamber of an electron irradiation apparatus (CB250 available from Iwasaki Electric Co., Ltd.) and the treatment chamber was purged with nitrogen to generate a non-oxidizing atmosphere. In this state, the tubular body was rotated about the shaft by 90 degrees at each time, and each 90-degree angular range of the outer peripheral surface was irradiated with electron radiation at a dose of 330 kGy at an acceleration voltage of 150 kV. Thus, a semiconductive roller was produced.

Examples 2 and 3, and Comparative Examples 1 and 2

Rubber compositions were prepared in substantially the same manner as in Example 1, except that the proportion of the ECO was set to 45 mass % (Comparative Example 1), 50 mass % (Example 2), 80 mass % (Example 3) and 90 mass % (Comparative Example 2) by adjusting the amounts of the ECO and the NBR. Then, semiconductive rollers were produced in the same manner as in Example 1 by using the rubber compositions thus prepared.

Example 4

A rubber composition was prepared in substantially the same manner as in Example 1, except that lithium bis (trifluoromethanesulfonyl)imide (EF-N115 available from Mitsubishi Materials Electronic Chemicals Co., Ltd.) was blended as the electrically conductive agent in the same amount as in Example 1. Then, a semiconductive roller was produced in the same manner as in Example 1 by using the rubber composition thus prepared.

Example 5

A rubber composition was prepared in substantially the same manner as in Example 1, except that 2.0 parts by mass of 2,4,6-trimercapto-s-triazine (triazine crosslinking agent ACTOR (registered trade name) TSH available from Kawaguchi Chemical Industry Co., Ltd.) based on 100 parts by mass of the overall rubber component was blended instead of the thiourea crosslinking agent and the accelerating agent DT. Then, a semiconductive roller was produced in the same manner as in Example 1 by using the rubber composition thus prepared.

Comparative Example 3

A tubular body yet to be subjected to the irradiation with the electron radiation was produced in the same manner as in Example 1, and the outer peripheral surface of the tubular body was wiped with an alcohol. Then, the tubular body was set in a UV irradiation apparatus (PL21-200 available from Sen Lights Corporation) with its outer peripheral surface spaced 50 mm from a UV light source. Then, the tubular body was rotated about the shaft by 90 degrees at each time, and each 90-degree angular range of the outer peripheral surface was irradiated with ultraviolet radiation at wavelengths of 184. 9 nm and 253.7 nm for 5 minutes. This operation was performed four times for each 90-degree angular range of the outer peripheral surface. Thus, an oxide film was formed in the entire outer peripheral surface. In this manner, the semiconductive roller was completed.

<Measurement of Roller Resistance>

The roller resistance of each of the semiconductive rollers produced in Examples and Comparative Examples was measured in an ordinary temperature and ordinary humidity environment at a temperature of 23±2° C. at a relative humidity of 55±2% by the aforementioned measurement method. The roller resistances are each expressed in the form of log R in Tables 2 and 3.

<Actual Machine Test>

A photoconductor unit (available from Lexmark International, Inc.) including a photoreceptor body and a charging roller constantly kept in contact with the surface of the photoreceptor body and attachable to a laser printer main body was prepared, and the semiconductive rollers produced in Examples and Comparative Examples were each incorporated as a charging roller instead of the original charging roller of the photoconductor unit.

Immediately after the photoconductor unit in which the semiconductive roller was incorporated was mounted in a color laser printer (CS510dn available from Lexmark International, Inc.), a halftone image and a solid image were printed by the color laser printer, and used as initial images for evaluation.

In the evaluation, a semiconductive roller suffering from defective image formation was rated as unacceptable (x), and a semiconductive roller free from the defective image formation was rated as acceptable (○).

After paper sheets were passed through the color laser printer at a rate of 2000 sheets per day for 5 days, 5 halftone images and 5 solid images were successively formed, and then the outer peripheral surface of the semiconductive roller was observed and evaluated for the adhesion and the accumulation of minute particles.

In the evaluation, a semiconductive roller having an outer peripheral surface entirely whitened due to the adhesion of minute particles was rated as unacceptable (x), and a semiconductive roller having an outer peripheral surface slightly whitened was rated as practically acceptable (Δ). A semiconductive roller having an outer peripheral surface free from the whitening was rated as acceptable (○).

Immediately after another photoconductor unit in which the semiconductive roller was incorporated was prepared, the photoconductor unit was allowed to stand still in a higher temperature and higher humidity environment at a temperature of 50° C. at a relative humidity of 90% for 14 days, and mounted in the same color laser printer. Then, 5 halftone images and 5 solid images were successively printed. In this manner, a storage test was performed.

In evaluation, a semiconductive roller which caused a white streaking imaging defect on at least one of the images during the successive printing was rated as unacceptable (x), and a semiconductive roller which caused the white streaking imaging defect on none of the images during the successive printing was rated as acceptable (○).

The above results are shown in Tables 2 and 3.

TABLE 2

| | | Comparative Example 3 | Comparative Example 1 | Example 2 | Example 1 |
|---|---|---|---|---|---|
| | | Parts by mass | | | |
| Rubber component | ECO | 60 | 45 | 50 | 60 |
| | NBR | 40 | 55 | 50 | 40 |
| Ion salt | K-TFSI | 1 | 1 | 1 | 1 |
| | Li-TFSI | — | — | — | — |
| Sulfur crosslinking component | Sulfur powder | 1.5 | 1.5 | 1.5 | 1.5 |
| | Accelerating agent DM | 1.5 | 1.5 | 1.5 | 1.5 |
| | Accelerating agent TS | 0.5 | 0.5 | 0.5 | 0.5 |
| Thiourea crosslinking agent | | 0.6 | 0.6 | 0.6 | 0.6 |
| Accelerating agent DT | | 0.54 | 0.54 | 0.54 | 0.54 |

TABLE 2-continued

| | | Comparative Example 3 | Comparative Example 1 | Example 2 | Example 1 |
|---|---|---|---|---|---|
| Triazine crosslinking agent | | — | — | — | — |
| Treatment of outer peripheral surface | | UV | Electron | Electron | Electron |
| Evaluation | | | | | |
| Roller resistance (log R) | | 5.8 | 6.2 | 6.0 | 5.3 |
| Actual machine test | Initial image | ○ | x | ○ | ○ |
| | Whitening of peripheral surface | x | — | ○ | ○ |
| | Storage test | ○ | — | ○ | ○ |

TABLE 3

| | | Example 3 | Comparative Example 2 | Example 4 | Example 5 |
|---|---|---|---|---|---|
| Parts by mass | | | | | |
| Rubber component | ECO | 80 | 90 | 60 | 60 |
| | NBR | 20 | 10 | 40 | 40 |
| Ion salt | K-TFSI | 1 | 1 | — | 1 |
| | Li-TFSI | — | — | 1 | — |
| Sulfur crosslinking component | Sulfur powder | 1.5 | 1.5 | 1.5 | 1.5 |
| | Accelerating agent DM | 1.5 | 1.5 | 1.5 | 1.5 |
| | Accelerating agent TS | 0.5 | 0.5 | 0.5 | 0.5 |
| Thiourea crosslinking agent | | 0.6 | 0.6 | 0.6 | — |
| Accelerating agent DT | | 0.54 | 0.54 | 0.54 | — |
| Triazine crosslinking agent | | — | — | — | 2.0 |
| Treatment of outer peripheral surface | | Electron | Electron | Electron | Electron |
| Evaluation | | | | | |
| Roller resistance (log R) | | 5.0 | 4.8 | 5.1 | 5.2 |
| Actual machine test | Initial image | ○ | ○ | ○ | ○ |
| | Whitening of peripheral surface | Δ | x | ○ | ○ |
| | Storage test | ○ | x | ○ | ○ |

The results for Examples 1 to 5 and Comparative Example 3 shown in Tables 2 and 3 indicate that, where the outer peripheral surface of the semiconductive roller is modified by the irradiation with the electron radiation in the non-oxidizing atmosphere, the adhesion of the minute particles can be advantageously suppressed as compared with the conventional case in which the oxide film is formed by the irradiation with the ultraviolet radiation in the oxidizing atmosphere.

The results for Examples 1 to 3 and Comparative Example 2 indicate that, in order to further advantageously suppress the adhesion of the minute particles and impart the semiconductive roller with excellent rubber characteristic properties to prevent the permanent compressive deformation, the proportion of the epichlorohydrin rubber to be blended in the rubber composition for the semiconductive roller should be not greater than 80 mass % based on the amount of the rubber component, and is particularly preferably not greater than 60 mass %.

The results for Examples 1 to 3 and Comparative Example 1 indicate that, in order to impart the semiconductive roller with proper semiconductivity, the proportion of the epichlorohydrin rubber should be not less than 50 mass % based on the amount of the rubber component.

The results for Examples 1 and 4 indicate that the ion salt is preferably blended in the semiconductive rubber composition, and the potassium salt and the lithium salt are preferred as the ion salt.

The results for Examples 1 and 5 indicate that, even if the triazine crosslinking agent is used as the crosslinking agent for the epichlorohydrin rubber instead of the thiourea crosslinking agent and the accelerating agent, the same effects can be provided.

This application corresponds to Japanese Patent Application No. 2015-088626 filed in the Japan Patent Office on Apr. 23, 2015, the disclosure of which is incorporated herein by reference in its entirety.

What is claimed is:

1. A semiconductive roller comprising a crosslinking product of a rubber composition and having an outer peripheral surface irradiated with electron radiation in a non-oxidizing atmosphere, wherein the rubber composition comprises:

a rubber component including an epichlorohydrin rubber and a diene rubber, the epichlorohydrin rubber being present in a proportion of not less than 50 mass % and not greater than 80 mass % based on a total amount of the epichlorohydrin rubber and the diene rubber;

at least one cross linking agent selected from the group consisting of a thiourea crosslinking agent and a triazine crosslinking agent; and a sulfur crosslinking component.

2. The semiconductive roller according to claim 1, wherein the proportion of the epichlorohydrin rubber is not greater than 60 mass % based on the total amount of the epichlorohydrin rubber and the diene rubber.

3. The semiconductive roller according to claim 2, wherein the rubber composition further comprises a potassium salt or a lithium salt, as an electrically conductive agent, containing an anion having a fluoro group and a sulfonyl group in its molecule.

4. The semiconductive roller according to claim 1, wherein the rubber composition further comprises a potassium salt or a lithium salt, as an electrically conductive agent, containing an anion having a fluoro group and a sulfonyl group in its molecule.

5. An image forming apparatus, which incorporates the semiconductive roller according to claim 1 as a charging roller for electrically charging a surface of a photoreceptor body.

* * * * *